US012674324B2

(12) United States Patent
Henderson

(10) Patent No.: US 12,674,324 B2
(45) Date of Patent: Jul. 7, 2026

(54) ROOF DRAIN AND PROMENADE SUPPORT

(71) Applicant: Zurn Water, LLC, Milwaukee, WI (US)

(72) Inventor: Matthew Curtis Henderson, Girard, PA (US)

(73) Assignee: Zurn Water, LLC, Milwaukee, WI (US)

( * ) Notice: Subject to any disclaimer, the term of this patent is extended or adjusted under 35 U.S.C. 154(b) by 680 days.

(21) Appl. No.: 18/052,318

(22) Filed: Nov. 3, 2022

(65) Prior Publication Data

US 2023/0139368 A1 May 4, 2023

Related U.S. Application Data

(60) Provisional application No. 63/275,296, filed on Nov. 3, 2021.

(51) Int. Cl.

| | |
|---|---|
| ***E04D 13/12*** | (2006.01) |
| ***E04D 13/04*** | (2006.01) |
| ***E04F 15/024*** | (2006.01) |

(52) U.S. Cl.

CPC ..... *E04D 13/12* (2013.01); *E04D 13/0409* (2013.01); *E04F 15/0247* (2013.01); *E04D 2013/0413* (2013.01)

(58) Field of Classification Search

CPC ..... E04D 13/12; E04D 13/0409; E04D 2013/0413; E04D 11/007; E04F 15/0247; E04F 15/02044; E04F 2015/02061

See application file for complete search history.

(56) References Cited

U.S. PATENT DOCUMENTS

| | | | |
|---|---|---|---|
| 60,153 | A | 12/1866 | Diven |
| 550,460 | A | 11/1895 | Shanks |
| 810,879 | A | 1/1906 | Perry |
| 902,104 | A | 10/1908 | Neireiter |
| 1,266,948 | A | 5/1918 | Holt |
| 1,342,918 | A | 6/1920 | Legg |
| 1,494,234 | A | 5/1924 | Gossett |

(Continued)

FOREIGN PATENT DOCUMENTS

| | | | | |
|---|---|---|---|---|
| CN | 111456371 A | * | 7/2020 | ..... E04F 15/02044 |
| CN | 112814289 A | * | 5/2021 | ..... E04D 13/0409 |

(Continued)

OTHER PUBLICATIONS

Jay R. Smith Mfg. Co., "Roof Drain Technical Data Sheet," Manual @ 2008 (19 pages).

(Continued)

*Primary Examiner* — Babajide A Demuren
(74) *Attorney, Agent, or Firm* — Husch Blackwell LLP

(57) ABSTRACT

A drain support is configured for installation on a surface and to support one or more floor tiles. The drain support includes a base at least partially defining a channel and an outlet, wherein the base defines a base axis, a support dome coupled to the base, wherein the support dome includes at least one aperture formed therein configured to allow fluid to flow from a position outside the dome into the channel, and a pedestal defining a support surface configured to support one or more floor tiles thereon during use, wherein the pedestal is movably coupled to the support dome.

26 Claims, 7 Drawing Sheets

(56) References Cited

U.S. PATENT DOCUMENTS

| | | | |
|---|---|---|---|
| 1,538,924 | A | 5/1925 | Boosey |
| 1,582,646 | A | 4/1926 | Flesch et al. |
| 1,593,550 | A | 7/1926 | Holt |
| 1,647,414 | A | 11/1927 | Moore |
| 1,690,630 | A | 11/1928 | Fleming |
| 1,710,304 | A | 4/1929 | Flynn et al. |
| 1,761,257 | A | 6/1930 | Fleming |
| 1,918,509 | A | 7/1933 | Wilcox |
| 1,991,772 | A | 2/1935 | Rieger et al. |
| 2,019,779 | A | 11/1935 | Fleming |
| 2,091,927 | A | 8/1937 | Hirshstein |
| 2,119,923 | A | 6/1938 | Mcintyre |
| 2,121,220 | A | 6/1938 | Filkins |
| 2,142,343 | A | 1/1939 | Boosey |
| 2,256,626 | A | 9/1941 | Rile |
| 2,283,365 | A | 5/1942 | Heinkel |
| 2,284,416 | A | 5/1942 | Gordon |
| 2,311,654 | A | 2/1943 | Filkins |
| 2,490,075 | A | 12/1949 | Matheis |
| 2,517,195 | A | 8/1950 | Gasper |
| 2,572,208 | A | 10/1951 | Sievert |
| 2,599,205 | A | 6/1952 | Schmid |
| 2,666,493 | A | 1/1954 | Gordon |
| 2,689,017 | A | 9/1954 | Schmid |
| 2,711,127 | A | 6/1955 | O'Day |
| 2,765,865 | A | 10/1956 | Schmid |
| 2,837,212 | A | 6/1958 | Schmid |
| 2,888,138 | A | 5/1959 | Baker et al. |
| 2,898,129 | A | 8/1959 | Sisk |
| 3,357,561 | A | 12/1967 | Schmid et al. |
| 3,378,858 | A | 4/1968 | Jacuzzi |
| 3,447,329 | A | 6/1969 | Emberson |
| 3,469,698 | A | 9/1969 | Blendermann |
| 3,481,632 | A | 12/1969 | Suess |
| 3,774,765 | A | 11/1973 | Kane et al. |
| 3,811,644 | A | 5/1974 | Arnault |
| 3,894,302 | A | 7/1975 | Lasater |
| 3,909,412 | A | 9/1975 | Patry |
| 4,073,018 | A | 2/1978 | Arrowood |
| D255,596 | S | 6/1980 | Johnson |
| 4,230,346 | A | 10/1980 | Goebel |
| 4,246,664 | A | 1/1981 | Reynolds |
| 4,400,272 | A | 8/1983 | Logsdon |
| 4,437,687 | A | 3/1984 | Wilson |
| 4,487,690 | A | 12/1984 | Logsdon |
| 4,505,814 | A | 3/1985 | Marshall |
| 4,525,273 | A | 6/1985 | Logsdon |
| 4,652,365 | A | 3/1987 | Ebeling |
| 4,799,713 | A | 1/1989 | Uglow |
| 4,839,927 | A | 6/1989 | Watanabe |
| 4,943,100 | A | 7/1990 | Emberson |
| 4,961,848 | A | 10/1990 | Logsdon |
| 4,984,308 | A | 1/1991 | Handal |
| 4,984,309 | A | 1/1991 | Lowry |
| D318,101 | S | 7/1991 | Rodgers |
| 5,174,128 | A | 12/1992 | Bourne et al. |
| 5,234,582 | A | 8/1993 | Savoie |
| 5,372,715 | A | 12/1994 | Maggard et al. |
| 5,378,356 | A | 1/1995 | Lonsdon |
| 5,458,769 | A | 10/1995 | Johannessen |
| 5,526,613 | A | 6/1996 | Simeone, Jr. |
| 5,618,416 | A | 4/1997 | Haefner |
| 5,689,928 | A | 11/1997 | Rasksen |
| 5,702,596 | A | 12/1997 | Juple et al. |
| 5,724,777 | A | 3/1998 | Hubbard |
| 5,735,091 | A | 4/1998 | Hawkins et al. |
| 5,749,190 | A | 5/1998 | Williams |
| 5,800,092 | A | 9/1998 | Nill et al. |
| 5,902,008 | A | 5/1999 | Butsuen et al. |
| 5,966,884 | A | 10/1999 | Uglow |
| 6,041,556 | A | 3/2000 | Keller |
| 6,056,014 | A | 5/2000 | Kojima et al. |
| 6,209,572 | B1 | 4/2001 | Wicklund |
| D460,810 | S | 7/2002 | Sommerhein |
| 6,594,966 | B2 | 7/2003 | Froeter |
| 6,615,417 | B1 | 9/2003 | Newhard |
| 6,631,588 | B1 | 10/2003 | Distler |
| 6,647,682 | B2 | 11/2003 | Bishop |
| 6,810,537 | B1 | 11/2004 | Barnes et al. |
| 6,833,067 | B2 | 12/2004 | Dresmann |
| 6,953,208 | B2 | 10/2005 | Warnecke |
| 7,010,889 | B1 | 3/2006 | Renfro |
| 7,011,746 | B2 | 3/2006 | Bockmann |
| 7,415,802 | B2 | 8/2008 | Froeter et al. |
| 7,591,111 | B2 | 9/2009 | Froeter et al. |
| 7,614,198 | B1 | 11/2009 | Piskula et al. |
| 7,658,043 | B2 | 2/2010 | Wroblewski |
| 7,739,757 | B2 | 6/2010 | Witt |
| 7,997,038 | B2 | 8/2011 | Warnecke et al. |
| 8,146,308 | B2 | 4/2012 | Warnecke et al. |
| 8,347,424 | B2 | 1/2013 | Wroblewski et al. |
| 8,850,633 | B2 | 10/2014 | Erlebach |
| 8,881,490 | B2 | 11/2014 | Wroblewski et al. |
| 9,103,107 | B2 | 8/2015 | Wroblewski et al. |
| 9,422,709 | B2 | 8/2016 | Wroblewski et al. |
| 9,428,900 | B2 | 8/2016 | Wroblewski et al. |
| 9,453,331 | B1 | 9/2016 | Buffington |
| 9,458,616 | B2 | 10/2016 | Whiteside |
| 9,518,389 | B1 | 12/2016 | McDanal |
| 9,643,113 | B2 | 5/2017 | Farmer et al. |
| 9,945,125 | B2 | 4/2018 | Huber |
| 10,167,622 | B2 | 1/2019 | Brooks et al. |
| 10,428,529 | B1 | 10/2019 | Tanghongs |
| 10,519,666 | B2 | 12/2019 | Huber |
| 10,711,447 | B2 | 7/2020 | Say et al. |
| 10,711,463 | B2 | 7/2020 | Huber |
| 10,907,356 | B2 | 2/2021 | Mechler et al. |
| 10,961,714 | B2 | 3/2021 | Herrero-Smith et al. |
| 11,047,126 | B1 | 6/2021 | Whiteside |
| 11,441,305 | B1 | 9/2022 | Alhazza |
| 2003/0037498 | A1 | 2/2003 | Bishop |
| 2003/0084631 | A1 | 5/2003 | Froeter |
| 2003/0141231 | A1 | 7/2003 | Rattenbury et al. |
| 2004/0182763 | A1 | 9/2004 | Bockmann |
| 2006/0053544 | A1 | 3/2006 | Hui |
| 2007/0137126 | A1 | 6/2007 | Sommerhein |
| 2009/0065071 | A1 | 3/2009 | Vahlbrauk |
| 2011/0209279 | A1 | 9/2011 | Ball |
| 2011/0314748 | A1 | 12/2011 | Smith |
| 2013/0333304 | A1 | 12/2013 | Smith |
| 2014/0069854 | A1 | 3/2014 | Sutherland |
| 2014/0308076 | A1* | 10/2014 | Tabibnia ..... E04F 15/02452 404/99 |
| 2015/0184398 | A1* | 7/2015 | Tabibnia ..... E04B 5/48 52/126.6 |
| 2016/0153195 | A1 | 6/2016 | Johnsen |
| 2016/0230393 | A1 | 8/2016 | Huber |
| 2016/0333586 | A1 | 11/2016 | King |
| 2018/0080484 | A1 | 3/2018 | Venkatesan et al. |
| 2018/0112407 | A1 | 4/2018 | Herrero-Smith et al. |
| 2018/0195287 | A1 | 7/2018 | Huber |
| 2018/0195288 | A1 | 7/2018 | Huber |
| 2019/0078311 | A1 | 3/2019 | Paivinen |
| 2019/0383019 | A1 | 12/2019 | Hetzler et al. |
| 2019/0383020 | A1 | 12/2019 | Mechler et al. |
| 2020/0340230 | A1 | 10/2020 | Say et al. |
| 2020/0378126 | A1 | 12/2020 | Huber |
| 2021/0238839 | A1 | 8/2021 | Say et al. |
| 2021/0317666 | A1 | 10/2021 | Majocka et al. |
| 2022/0025653 | A1 | 1/2022 | Huber |
| 2022/0120086 | A1 | 4/2022 | Majocka et al. |
| 2022/0316213 | A1 | 10/2022 | Huber |
| 2022/0316214 | A1 | 10/2022 | Williams |

FOREIGN PATENT DOCUMENTS

| | | | | |
|---|---|---|---|---|
| DE | 19840593 | A1 * | 3/2000 | ..... E03F 5/0409 |
| DE | 202008003464 | U1 * | 9/2009 | ..... E04D 11/007 |
| DE | 102012007180 | A1 * | 8/2012 | ..... E04D 13/0409 |
| DE | 202009018799 | U1 * | 10/2013 | ..... E04D 13/0409 |
| DE | 202015002483 | U1 * | 6/2015 | ..... E04F 15/02183 |
| DE | 102019135419 | A1 * | 6/2021 | ..... E04F 15/02044 |

(56) References Cited

FOREIGN PATENT DOCUMENTS

| | | | | |
|---|---|---|---|---|
| EP | 3550092 | A1 * | 10/2019 | ..... E04B 1/38 |
| GB | 2347451 | A | 9/2000 | |
| WO | 2017182711 | A1 | 10/2017 | |

OTHER PUBLICATIONS

Zurn, "Specific Drainage," SD0119 Customer Guide @ 2019 (12 pages).
Wade, "Roof Drains," Catalogue @ 2019, pp. 219-279.
Olympic Manufacturing Group (OMG, Inc.), Internet; Olyfast Accessories, Olyflow Drain Systems, FlowControl, OverFlow, and QuickFlow website: http://www.olyfast.com, viewed Feb. 28, 2005 (2 pages).

* cited by examiner

ROOF DRAIN AND PROMENADE SUPPORT

CROSS-REFERENCE TO RELATED APPLICATIONS

This application claims priority to U.S. Provisional Patent Application No. 63/275,296, filed Nov. 3, 2021, the entire contents of which are incorporated by reference herein.

FIELD

The embodiments described herein relate to a roof drain, and more particularly, to a roof drain that also serves as a floor panel support.

BACKGROUND

In promenade patio and/or terrace floors, the floor panels are supported by pedestals above a subfloor.

SUMMARY

In some embodiments, a drain support is configured for installation on a surface and to support one or more floor tiles. The drain support includes a base at least partially defining a channel and an outlet, wherein the base defines a base axis, a support dome coupled to the base, wherein the support dome includes at least one aperture formed therein configured to allow fluid to flow from a position outside the dome into the channel, and a pedestal defining a support surface configured to support one or more floor tiles thereon during use, wherein the pedestal is movably coupled to the support dome.

In other embodiments, a drain support is configured for installation on a surface. The drain support includes a base at least partially defining a channel and an outlet; a support dome including a base ring couplable to the base, a boss offset vertically from the base ring, and a plurality of ribs extending between the base ring and the boss; and a pedestal movably coupled to the boss.

In still other embodiments, a support dome for use with a drain defining a channel and an outlet includes a base ring, a boss offset vertically from the base ring, a plurality of ribs extending between the base ring and the boss and configured to convey forces therebetween, and a pedestal movably coupled to the boss.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
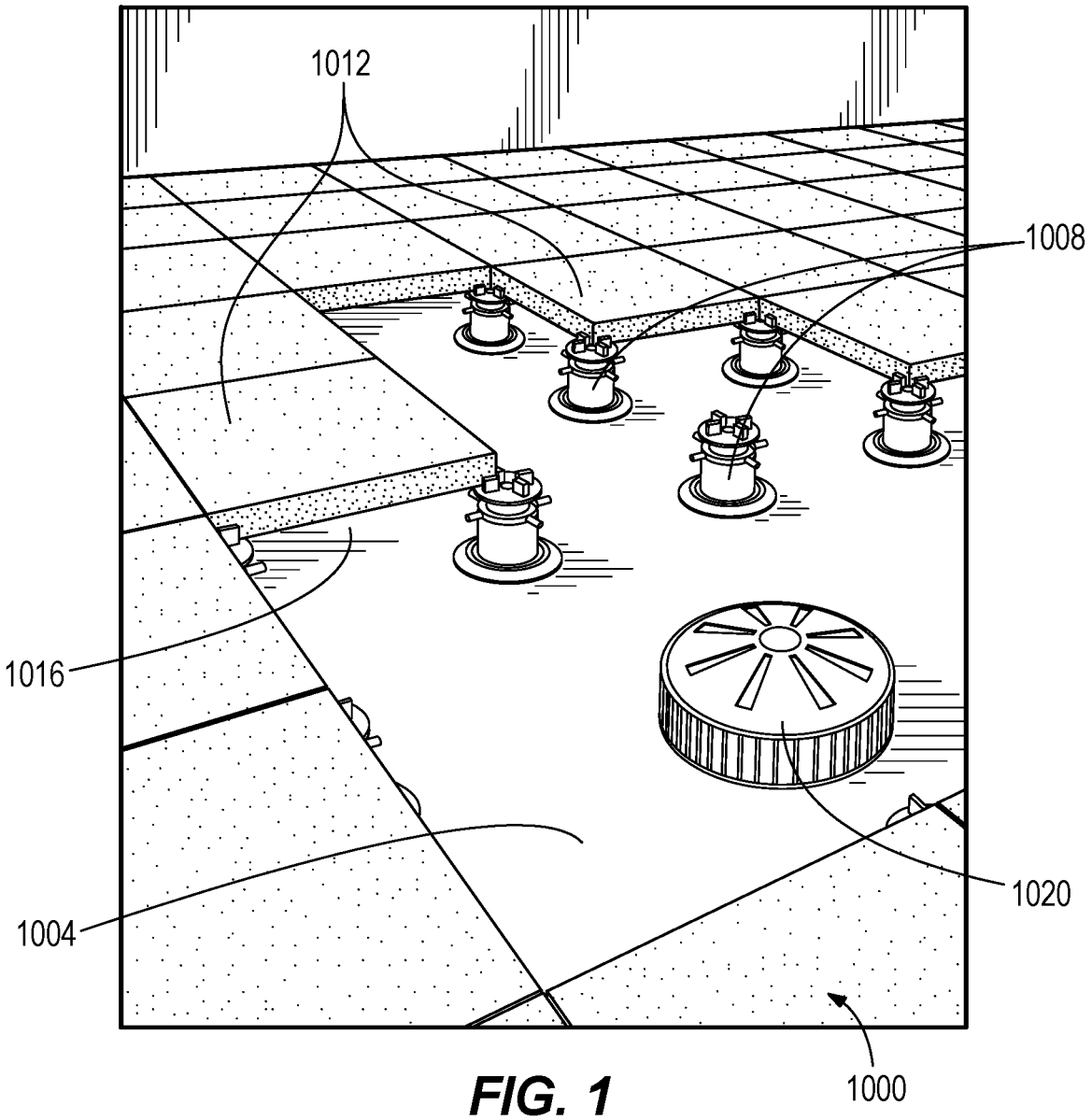
FIG. 1 PRIOR ART
FIG. 1 illustrates a first embodiment of a prior art roof floor assembly.

FIG. 1 illustrates a prior art roof-floor assembly 1000. More specifically, FIG. 1 illustrates a roof sub-floor 1004 and a plurality of paver pedestals or supports 1008 positioned thereon. During use, a plurality of floor plates 1012 are supported above the sub-floor 1004 by the paver supports 1008 to produce a floor gap 1016 therebetween. More specifically, the supports 1008 are oriented on the sub-floor 1004 in a rectangular array so that one support 1008 is positioned at each corner of the rectangular floor plates 1012. FIG. 1 also illustrates separate roof drain 1020 that is mounted on the sub-floor 1004 and positioned below the floor plates 1012. During use, the roof drain 1020 is completely independent from the floor plates 1012 and is configured to collect water that seeps through the floor and collects on the sub-floor 1004.

FIGS. 2-7 illustrate a combined drain support 200 for use within a roof assembly 204 or other elevated surface assembly to support one or more floor tiles 208 above a sub-floor or surface 212 to produce a patio, terrace, or other support surface. In the illustrated embodiment, the roof assembly 204 includes one or more combined drain supports 200 and one or more paver supports 216 that, together, are configured to support and position a plurality of floor tiles 208 above the sub-floor 212 to produce a floor gap 220 therebetween. More specifically, the combined drain support 200 is configured to be used in place of one of the paver supports 216 to allow for drainage capabilities and floor support in a single product. While the illustrated embodiment is used in a roof context, it is understood that in other embodiments the drain support 200 may be used with other surfaces and situations.

Figure 2:
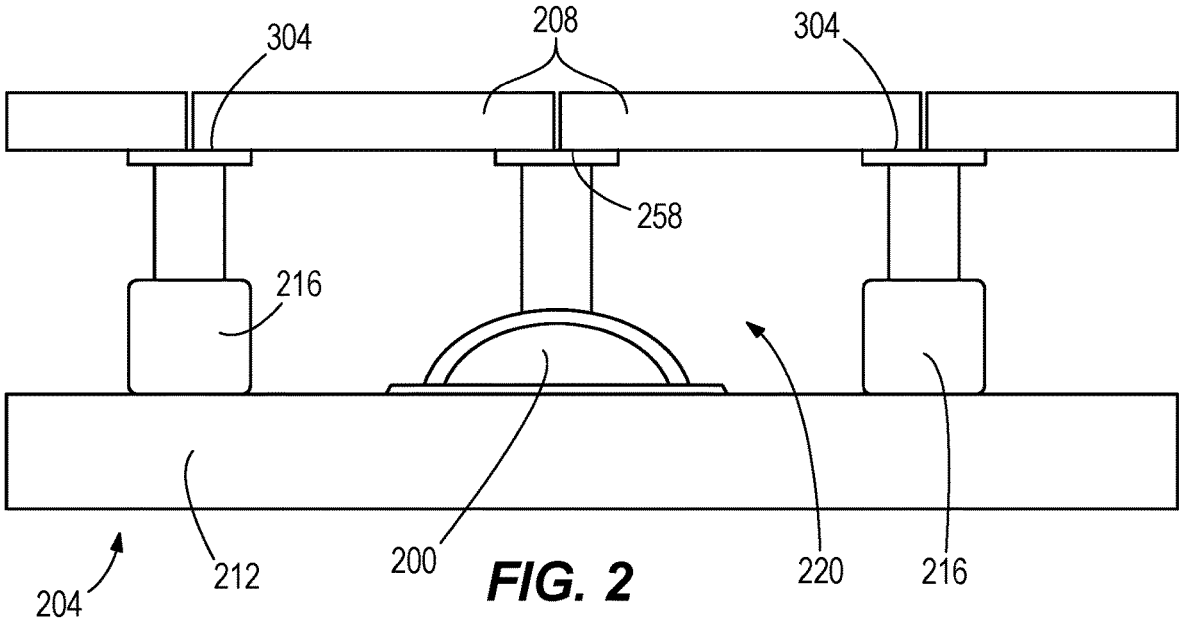
FIG. 2 is a side view of a roof floor assembly of the present description.
Figure 3:
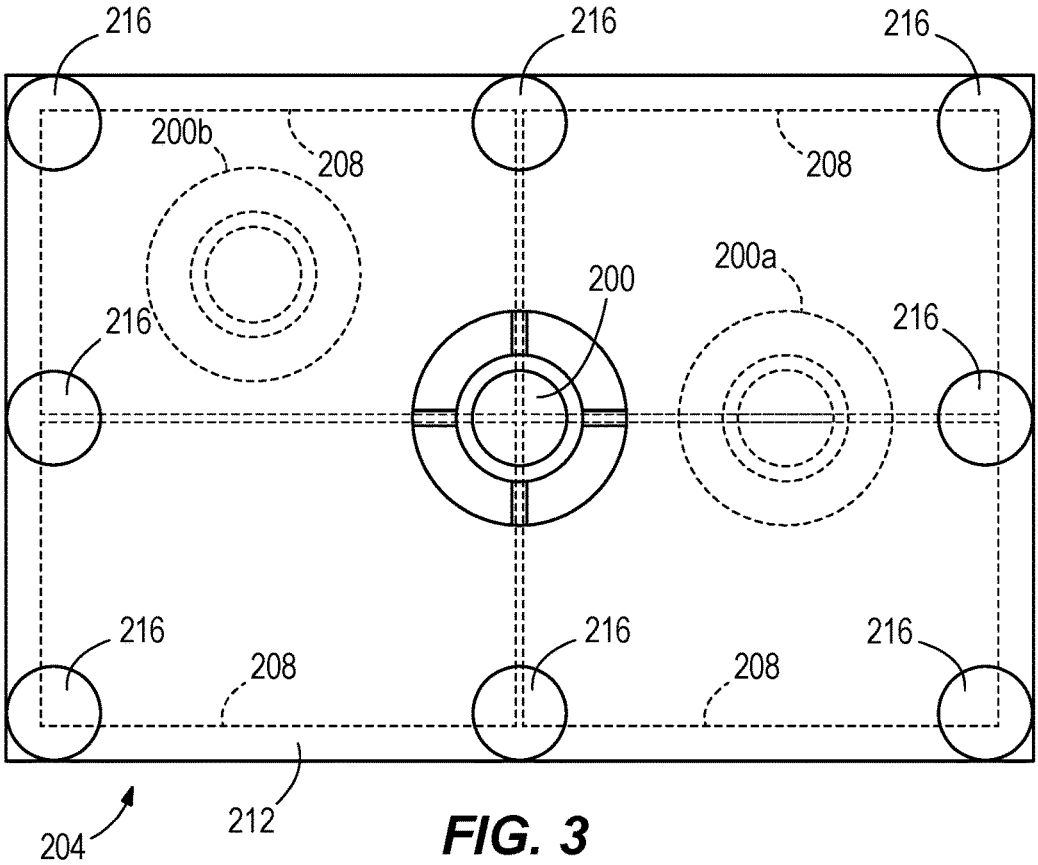
FIG. 3 is a top view of the roof floor assembly of FIG. 2.
Figure 4:
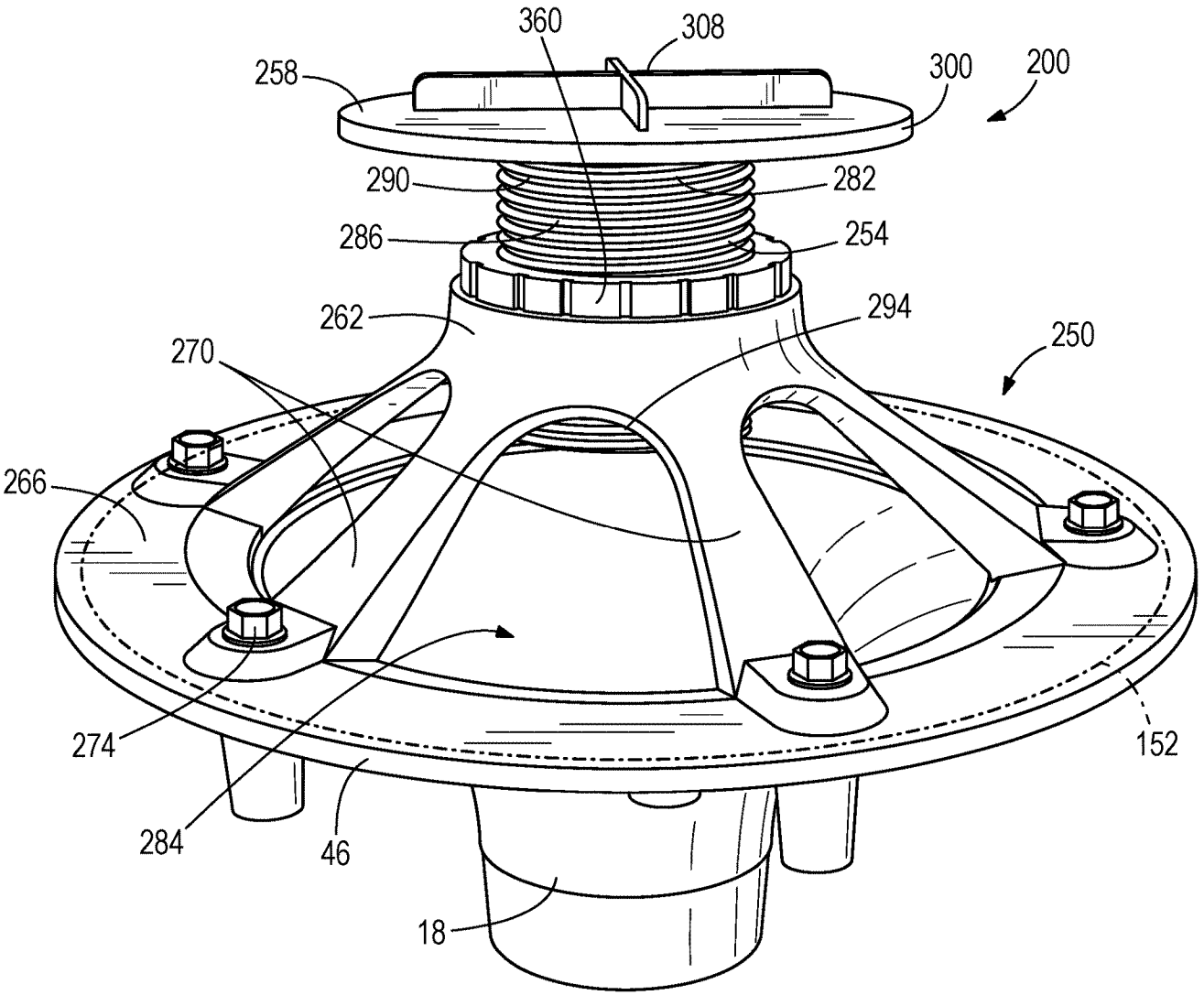
FIG. 4 is a perspective view of a combined roof drain assembly.
Figure 5:
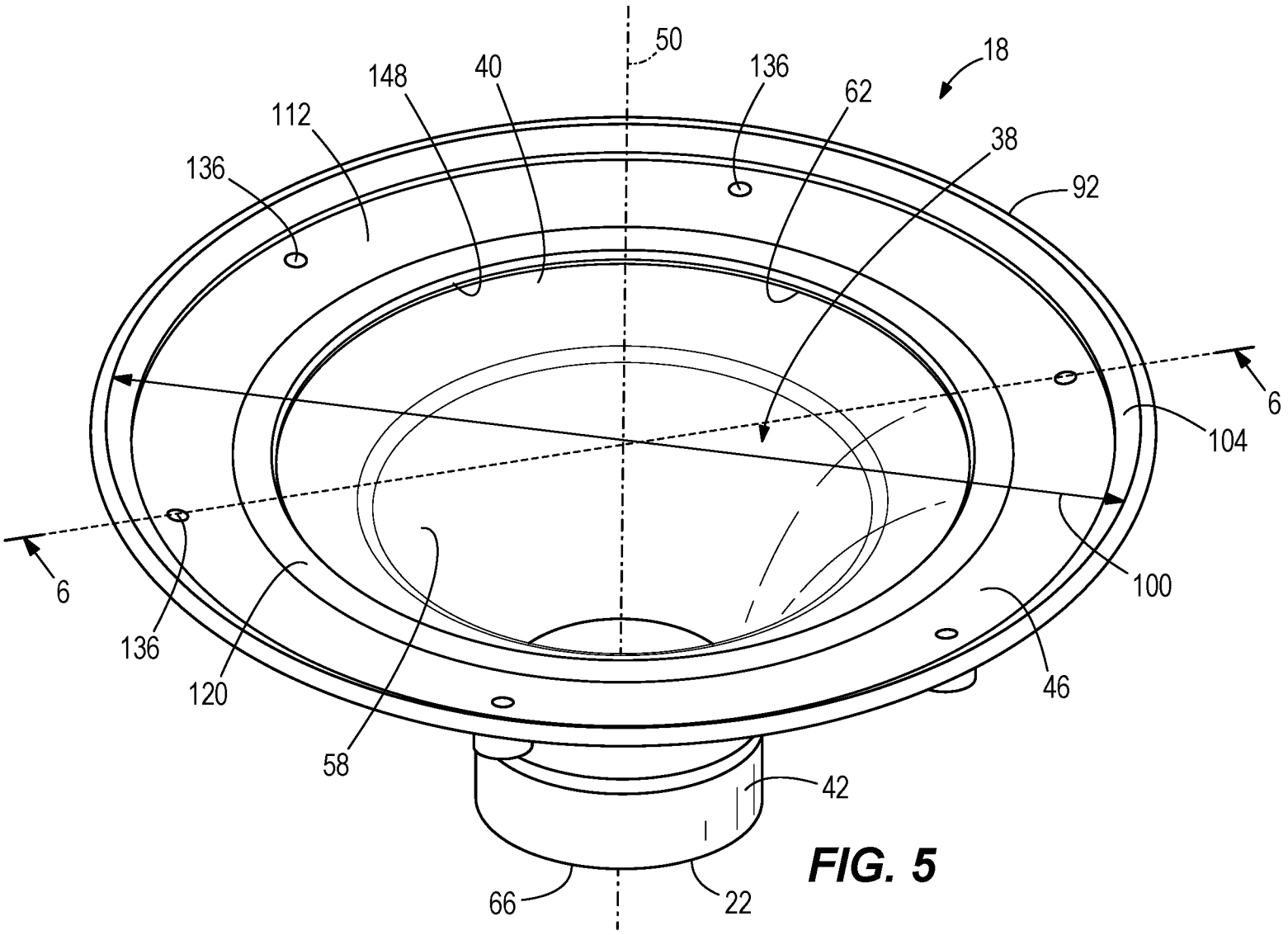
FIG. 5 is a perspective view of a base of the combined roof drain assembly of FIG. 4.

FIG. 3 illustrates the combined drain support 200 for mounting on the sub-floor 212. As illustrated in FIGS. 4 and 5, the drain support 200 includes a base 18 at least partially defining a channel 38, a support dome 250 coupled to the base 18, and a pedestal 254 adjustably coupled to the support dome 250 and including a support surface 258 atop which one or more floor tiles 208 (e.g., as illustrated in FIG. 2) may rest during use. When installed, the channel 38 of the drain support 200 is placed in fluid communication with a plumbing system (e.g., a network of conduits to reroute the rainwater off of the roof) of the corresponding building such that water accumulating on the sub-floor 212 (e.g., as illustrated in FIG. 2) is collected by the drain support 200 and directed into the plumbing system via the channel 38. With reference to FIGS. 2 and 4, the combined drain support 200 is also configured to provide structural support for one or more floor tiles 208 resting on the support surface 258 by transmitting any forces exerted upon the floor tiles 208 (e.g., a person standing on the tile 208, furniture or other items placed on the tiles 208, etc.) into the sub-floor 212.

As illustrated in FIG. 5, the base 18 of the drain support 200 is substantially "funnel" shaped defining the channel 38 through which rainwater may be directed into the plumbing system of the building. More specifically, when rainwater collects on the sub-floor 212, the water flows into the inlet 40 of the channel 38 where it is directed into the plumbing or drain system via the outlet 22 thereof. In the illustrated embodiment, the base 18 includes a throat portion 42 at least partially defining the channel 38, and a flange portion 46 extending radially outwardly from the throat portion 42. Together, the throat portion 42 and flange portion 46 define a central axis 50. While the illustrated base 18 is cast as a single piece of material, it is to be understood that in alternative embodiments, the base 18 may be formed as multiple pieces coupled together.

Figure 6:
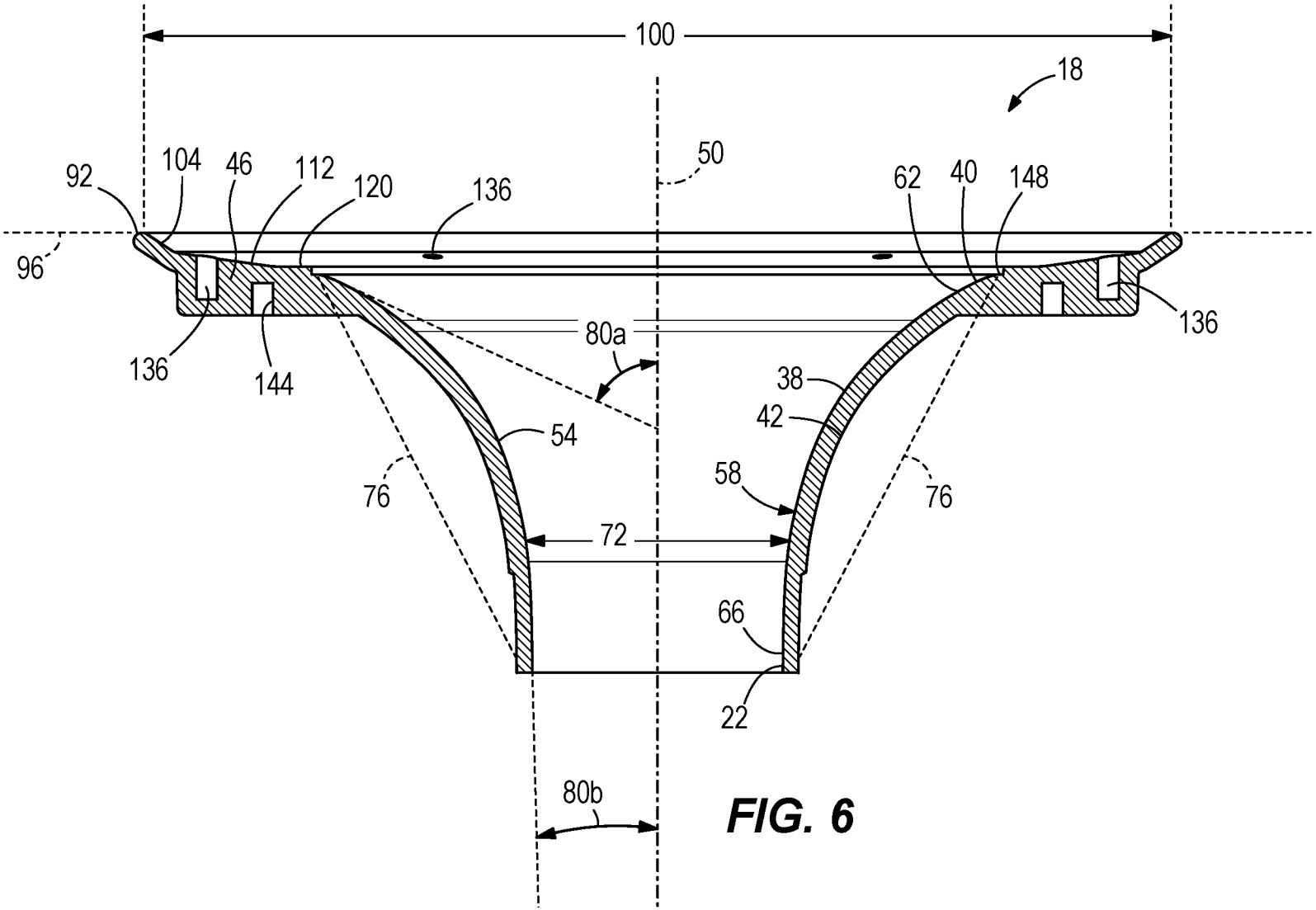
FIG. 6 is a section view taken alone line 6-6 of FIG. 5.
Figure 7:
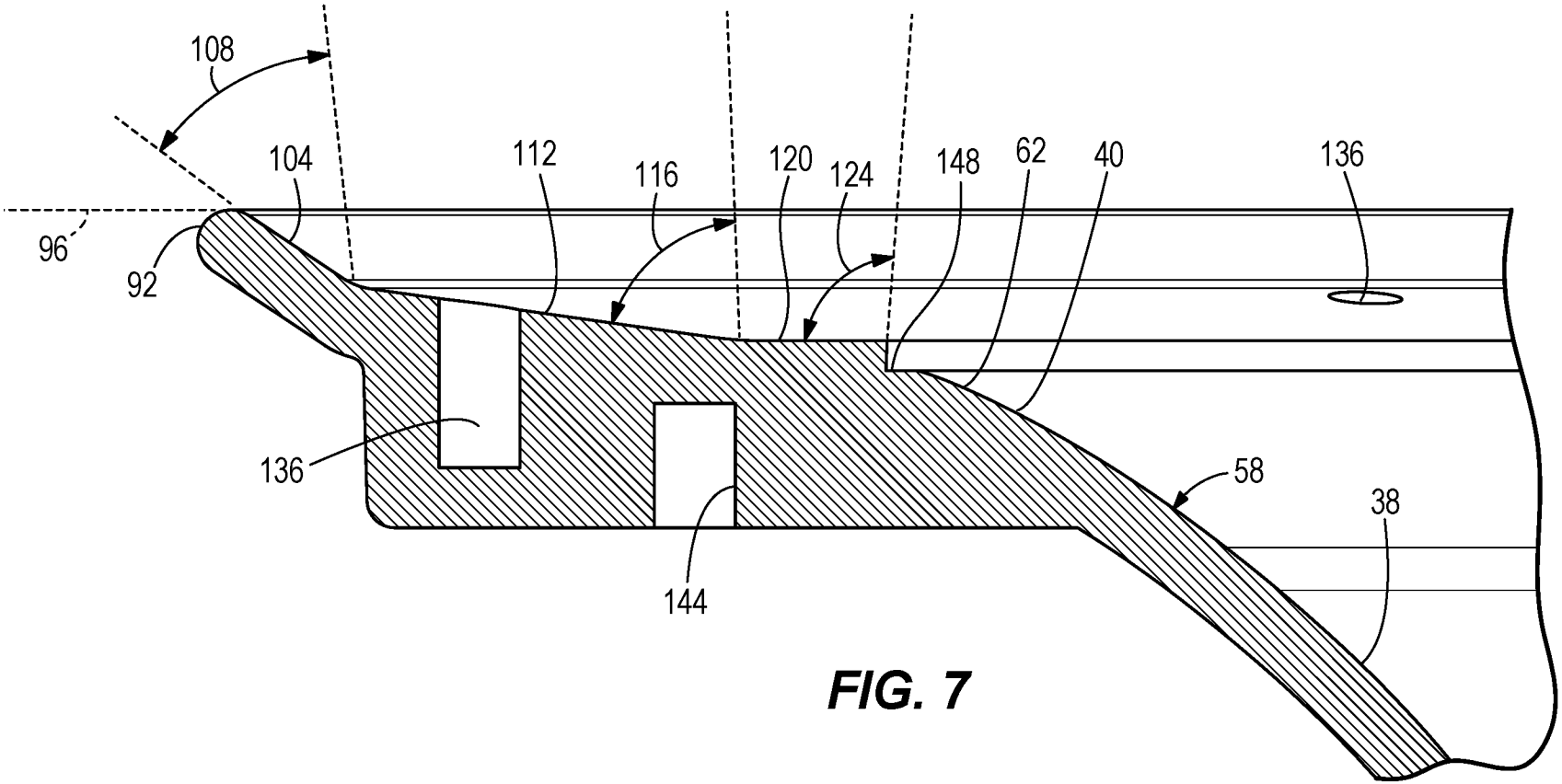
FIG. 7 is a detailed view of FIG. 6.

With reference to FIGS. 6 and 7, the throat portion 42 of the base 18 is formed from a substantially annular wall 54 having an inner surface 58, a first end 62 generally corresponding with the inlet 40 of the channel 38, and a second end 66 opposite the first end 62 that generally corresponds with and forms the outlet 22 of the channel 38. The inner surface 58 is shaped such that the inner diameter 72 of the inner surface 58 continuously and smoothly decreases as it extends axially away from the first end 62 and toward the second end 66. More specifically, the cross-sectional shape of the inner surface 58, taken along the axis 50, forms a substantially convex shape over its entire axial length (see FIG. 6). The throat portion 42 also defines a frusto-conical-datum surface 76 generally defined as a frusto-conically-shaped surface that is co-axial with the axis 50 and extends from the first end 62 to the second end 66. In such embodiments, the inner surface 58 is shaped such that it is always positioned radially inside the frusto-conical datum surface 76.

The inner surface 58 of the throat portion 42 forms a first surface angle 80*a* relative to the axis 50 at the first end 62 thereof and a second surface angle 80*b* relative to the axis 50 at the second end 66 thereof (see FIG. 6). In the illustrated embodiment, the first surface angle 80*a* is greater than the second surface angle 80*b*. Furthermore, the inner surface 58 smoothly transitions from the first surface angle 80*a* to the second surface angle 80*b* while always decreasing in value. In the illustrated embodiment, the first surface angle 80*a* is between approximately 40 and 70 degrees while the second surface angle 80*b* is between approximately 0 and 15 degrees. In other embodiments, the first angle 80*a* is between approximately 50 and 65 degrees. In still other embodiments, the first angle 80*a* is approximately one of 51 degrees, 52 degrees, 59 degrees, 60 degrees, and 62 degrees. Other embodiments, the second angle 80*b* may be between approximately 0 and 5 degrees. In still other embodiments, the second angle 80*b* may be approximately 3 degrees. In still other embodiments, the first angle 80*a* and second angle 80*b* may vary depending on the diameter of the outlet 22.

While the illustrated inner surface 58 provides a smooth, curved, convex shape, it is to be understood that alternative shapes may also be used. For example, an alternative embodiment of the throat portion having an alternative embodiment of the inner surface may include a frusto-conical portion and a cylindrical portion extending axially from the narrow end of the frusto-conical portion. In such embodiments, the frusto-conical portion may include a first constant surface angle that transitions to a second surface angle at the cylindrical portion. Such an inner surface does not include any concave portions (e.g., instances where the surface angle increases as it extends from the first end to the second end).

With continued reference to FIGS. 6 and 7, the flange portion 46 of the base 18 extends radially outwardly from the first end 62 of the throat portion 42 to produce an outer edge 92. The outer edge 92, in turn, defines a top plane 96 (e.g., generally oriented normal to the axis 50 and positioned at the axial highest point of the base 18), and an outer diameter 100. The flange portion 46 includes a first portion 104 extending radially inwardly from the outer edge 92 at a first surface angle 108 relative to the axis 50, a second portion 112 extending radially inwardly from the first portion 104 at a second surface angle 116 relative to the axis 50, and a third portion 120 extending radially inwardly from the second portion 112 at a third surface angle 124. As shown in FIG. 7, the first surface angle 108 is less than the second surface angle 116 (e.g., the first surface angle 108 is steeper than the second surface angle 116), and the second surface angle 116 is less than the third surface angle 124 (e.g., the second surface angle 116 is steeper than the third surface angle 124).

When installed, the top plane 96 of the flange portion 46 is generally positioned so that is aligned with the top surface of the sub-floor 212 positioned immediately adjacent thereto. As such, any roof membrane or paper 152 can transition from the sub-floor 212 to the base 18 without producing any high spots or bumps. Stated differently, the top surface of the sub-floor 212 is substantially aligned with the top plane 96. When the support dome 250 is coupled to the base 18, the support dome 250 is configured to capture the membrane 152 therebetween to forms a joint therebetween to secure the membrane 152 in place. In some embodiments, the resulting joint may also be waterproof.

The base 18 also includes a first plurality of threaded apertures 136 formed into the flange portion 46 and outside the channel 38. During use, the threaded apertures 136 are configured to receive a threaded fastener 140 therein to couple the support dome 250 to the base 18. Similarly, the base 18 includes a second plurality of threaded apertures 144 on the underside thereof for securing the base 18 to the sub-floor 212 or other building structure.

The base 18 also includes a cutting groove 148. The cutting groove 148 is formed into the base 18 at a first radial distance from the axis 50. During use, the cutting groove 148 is configured to receive and guide the tip of a knife or razor blade therein so the user can quickly and easily trim the roof paper 152 at the desired location. In the illustrated embodiment, the cutting groove 148 includes a "step" having two adjacent surfaces against which the user's blade may be pressed (e.g., into the corner formed by the two surfaces). However, in alternative embodiments, the groove 148 may be enclosed on three sides (not shown). In still other embodiments, the cutting groove 148 may include other shapes and contours desirable to directing the user during the cutting process. While the illustrated groove 148 is annular in shape, in alternative embodiments, alternative shapes (e.g., polygonal, stepped, and the like) may also be present to produce the desired final cut dimensions. In the illustrated embodiment, the cutting groove 148 is positioned radially inwardly of the dome 250 (described below). In some embodiments, the cutting groove 148 may be positioned at a location where the throat portion 42 meets the flange portion 46 at the radially inner barrier of the third portion 120 of the flange portion 46.

As shown in FIG. 6, the outlet 22 of the channel 38 generally defines an outlet diameter 24 generally corresponding to the size of the pipes forming the downspout of the plumbing system. For example, an outlet 22 having a 2" diameter substantially corresponds with a downspout formed from 2" pipe, an outlet having a 3" diameter substantially corresponds with a downspout formed from 3" pipe, and the like. It is understood that the size of the drain support 200 may vary proportionally dependent upon the outlet diameter 24 of the outlet 22.

As shown in FIG. 4, the support dome 250 of the combined drain support 200 is mounted to the flange portion 46 of the base 18 and provides a boss or mounting location 262 to which the pedestal 254 may be adjustably attached, as discussed below. More specifically, the support dome 250 includes a base ring 266, the boss 262 axially offset vertically above the base ring 266, and a plurality of ribs 270 extending between and coupled to both the base ring 266 and the boss 262. During use, the support dome 250 is configured to position and provide structural support for the pedestal 254 by transmitting any forces applied to the pedestal 254 (e.g., via the floor tiles 208) into the base 18 via the ribs 270 where the force is ultimately borne by the sub-floor 212.

In the illustrated embodiment, the base ring 266 is sized and shaped to correspond with the flange portion 46 of the base 18. More specifically, the size and shape of the base ring 266 and the flange portion 46 are such that the ring 266 and base 18 are co-axially aligned when coupled together. In the illustrated embodiment, the base ring 266 is coupled to the base 18 via a plurality of fasteners 274, however, in alternative embodiments different forms of attachment may be used.

The boss 262 of the support dome 250 is configured to provide an adjustable mounting location for the pedestal 254. More specifically, the boss 262 is configured to allow the pedestal 254 to be vertically adjusted relative to the base 18 while remaining co-axial therewith. In the illustrated embodiment, the boss 262 includes a set of internal threads (not shown) that are sized to threadingly engage external threads 282 of the pedestal 254 (discussed below). However, in alternative embodiments the boss 262 may include other forms of adjustment such as, but not limited to, locking pins received in axially spaced apertures, and the like. Furthermore, while the illustrated boss 262 is intended to maintain the pedestal 254 in a co-axial positioned relative to the base 18, it is understood that in alternative embodiments the boss 262 may also allow lateral (e.g., radial) adjustment in addition to vertical (e.g., axial) adjustment).

In the illustrated embodiment, the support dome 250 includes six radial ribs 270 extending between the boss 262 and the ring 266 forming apertures 284 therebetween that are open to the channel 38. During use, water or other fluids that collect on the sub-floor 212 outside the dome 250 flow through the apertures 284 and into the base 18 where the water is directed into the plumbing system via the channel 38. While the illustrated ribs 270 produce a few, relatively large apertures 284, it is understood that in alternative embodiments the layout of the ribs 270 may be changed so that different patterns are formed having different sized and positioned apertures 284. In some embodiments, the ribs 270 may be positioned so that the resulting apertures 284 are small enough to act as a sort of coarse filter to stop debris and other items from entering the channel 38.

The pedestal 254 of the combined drain support 200 is adjustably attached to the support dome 250 and provides a support surface 258 upon which one or more floor tiles 208 may be placed when in use. The pedestal 254 includes an elongated shaft 286 with a first end 290 and a second end 294 opposite the first end 290, and a support disk 300 coupled to the first end 290 of the elongated shaft 286 and including the support surface 258 thereon. In the illustrated embodiment, the elongated shaft 286 is at least partially threaded with external threads 282 configured to threadingly engage with the internal threads of the boss 262. More specifically, the second end 294 of the pedestal 254 is threaded into the boss 262 such that rotating the pedestal 254 relative to the support dome 250 causes the distance between the support surface 258 of the support disk 300 and the base 18 to change. This vertical adjustment permits the support surface 258 to be generally aligned with the support surfaces 304 of the adjacent paver supports 216.

The support disk 300 of the pedestal 254 is coupled to the first end 290 of the elongated shaft 286 such that the support surface 258 faces opposite thereof in a vertically upwards direction. While the illustrated support disk 300 is shown as a separate element from the pedestal 254, it is understood that in other embodiments both elements may be formed together.

During use, the support surface 258 of the support disk 300 is configured to contact the underside of one or more floor tiles 208 and support the weight of those tiles 208 thereon. The disk 300 may also include one or more ridges 308 and/or other alignment elements extending from or recessed therein to help laterally position and/or secure the tiles 208 with respect thereto. In the illustrated embodiment, the support disk 300 is configured to be positioned proximate the corners of four adjacent floor tiles 208. However, in other embodiments, the support disk 300 of the drain support **200*a* may be configured to be positioned along an edge of two adjacent tiles 208 (see FIG. 3). In still other embodiments, the support disk 300 of the drain support 200*b* may be configured to may be configured to be placed at the interior of a respective tile 208** away from the perimeter thereof.

In the illustrated embodiment, the support surface 258 of the support disk 300 also includes a "+" shaped ridge 308 extending therefrom. The ridge 308 is configured to help align the floor tiles 208 positioned thereon by establishing an even gap therebetween via the thickness of the ridge 308 itself. While the illustrated ridge 308 is "+" shaped, or plus symbol shaped, to help properly positioned four floor tiles 208 spaced corner to corner, it is understood that in alternative embodiments different shaped ridges 308 may also be present. For example, a linear ridge (not shown) can be included when two floor tiles 208 are positioned edge to edge (see drain support **200*a* of FIG. 3). In still other examples, no ridge 308 may be present when the drain support 200 is intended to be located near the center of a floor tile 208 (see drain support 200*b* of FIG. 3). In still other embodiments, the disk 300 may include tabs, pins, recesses, or a combination thereof to interact with corresponding elements of the tiles 208**.

The pedestal 254 also includes a locking element 360 in operable communication with the pedestal 254 and adjustable between a first configuration, in which the pedestal 254 can be moved relative to the support dome 250 and a second configuration in which the pedestal 254 cannot be moved relative to the support dome 250. In the illustrated embodiment, the locking element 360 includes a locking nut threaded on the elongated shaft 286 and configured to lock the pedestal 254 in place when it has been adjusted into the desired position. While the illustrated embodiment includes a locking nut 360, in alternative embodiments different forms of securing the pedestal in place, such as pins, tabs, and the like, may also be used.

To install the roof assembly 204, a plurality of paver supports 216 are laid on the roof sub-floor 212 whereby the paver supports 216 are positioned at the nodes of a rectangular array (see FIG. 3). As shown in FIG. 3, a combined drain support 200 is positioned at one of the nodes in place of a corresponding paver support 216 so that a combination of paver supports 216 and combined drain supports 200 complete the entire array.

With regards to the paver supports 216, each support 216 is generally secured to the sub-floor 212 by a series of fasteners (not shown). In other embodiments, the supports 216 may be held in place by embedding a portion of the support 216 into the sub-floor 212 itself. Furthermore, the base 18 of the combined drain supports 200 is also secured to the sub-floor 212 by fasteners or by embedding the base 18 therein. When installing the base 18, care is also taken to attach the outlet 22 of the base 18 to the drain system.

With the paver supports 216 and combined drain supports 200 in place, the user may then install the floor tiles 208 by placing the tiles 208 such that they are supported atop the array of paver supports 216 and combined drain supports 200. In the illustrated embodiment, the array of supports 216, 200 is such that the tiles 208 are generally supported at the corners thereof. The installed tiles 208 are positioned atop the supports 216, 200 such that they produce a floor gap 220 between themselves and the sub-floor 212.

During use, fluids such as rainwater and the like impinging upon the floor tiles 208 seeps through the gaps therebetween into the floor gap 220 to collect on the sub-floor 212. The collected fluids then flow toward the combined drain supports 200, flow through any apertures 284 of support dome 250, and into the drain system via the channel 38 of the base 18.

Figure 8:
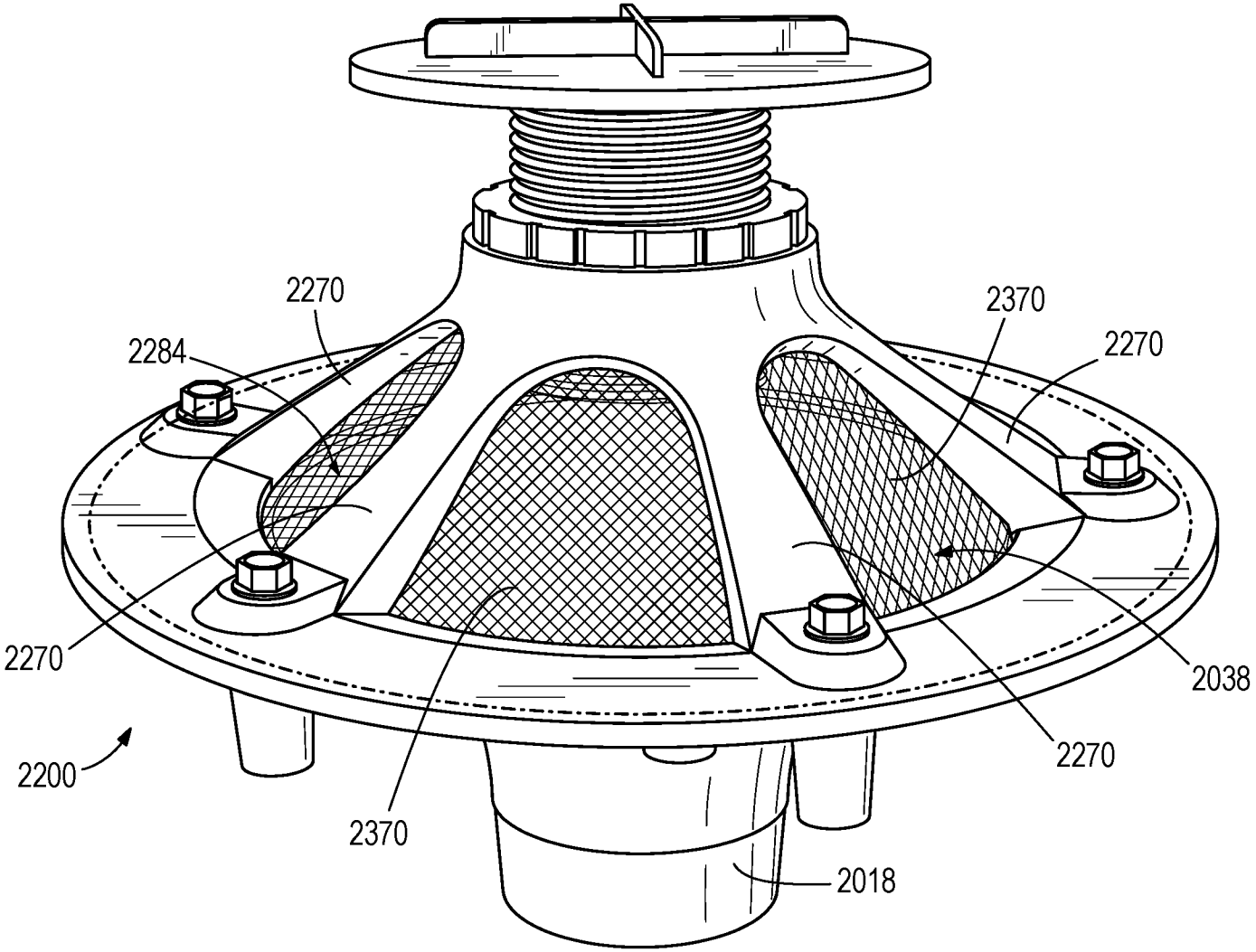
FIG. 8 is a perspective view of a roof floor assembly according to another embodiment of the present description.

FIG. 8 illustrates another embodiment of a drain support 2200. The drain support 2200 of FIG. 8 is substantially similar to the drain support 200 of FIG. 4. As such, only the differences between the drain support 2200 of FIG. 8 and the drain support 200 of FIG. 4 are described below. As illustrated in FIG. 8, the drain support 2200 includes a base 2018 defining a channel 2038 that is configured to be placed in fluid communication with the plumbing system of a building and a support dome 2250 that is couplable to the base 2018. The support dome 2250 has a plurality of ribs 2270 that define a plurality of apertures 2284 between adjacent ribs 2270. The support dome 2250 additionally has a mesh layer 2370 provided on an interior side of the support dome 2250. As such, the mesh layer 2370 extends between the plurality of ribs 2270 across the plurality of apertures 2284 on the interior side of the support dome 2250. The mesh layer 2370 is configured to allow fluid to flow through the plurality of apertures 2284 and through the mesh layer 2370 to enter the channel 2038. The mesh layer 2370 is configured to inhibit debris from entering the channel 2038 through the plurality of apertures 2284. For example, fluid build-up may gather debris such as twigs and rocks as the fluid flows towards the drain support 2200. While the illustrated mesh layer 2370 is shown as a separate element that is attached to the dome 2250, it is understood that in other embodiments the two elements may be formed together as a single unit. In still other embodiments, the mesh layer 2370 may be replaceable with other mesh layers 2370 to allow the user to adjust how coarse or fine debris must be to be captured.

Once the fluid reaches the drain support 2200, the fluid may flow through the plurality of apertures 2284 and the mesh layer 2370 while the mesh layer 2370 catches the debris and inhibits said debris from entering the channel 2038. In some embodiments, the drain support 2200 may include a perforated basket that couples to the support dome 2250 at an interior side of the support dome 2250 to inhibit debris from entering the channel 2038.

Although the invention has been described with reference to certain embodiments, variations and modifications exist within the spirit and scope of the invention. Various features of the invention are set forth in the following claims.

What is claimed is:

1. A drain support configured for installation on a surface and to support one or more floor tiles, the drain support comprising:

a base at least partially defining a channel and an outlet, wherein the base defines a base axis;

a support dome coupled to the base, wherein the support dome includes at least one aperture formed therein configured to allow fluid to flow from a position outside the support dome into the channel; and a pedestal defining a support surface configured to support one or more floor tiles thereon during use, wherein the pedestal is movably coupled to the support dome.

2. The drain support of claim 1, wherein the pedestal is movable with respect to the support dome in a direction parallel with the base axis.

3. The drain support of claim 1, wherein the pedestal includes a first set of threads formed thereon, and wherein the support dome includes a second set of threads configured to threadably engage with the first set of threads.

4. The drain support of claim 3, wherein the pedestal includes a support disk coupled thereto, and wherein the support disk defines the support surface.

5. The drain support of claim 1, further comprising a ridge extending from the support surface away from the support dome.

6. The drain support of claim 5, wherein the ridge has a plus symbol shape.

7. The drain support of claim 1, further comprising a locking element adjustable between a first configuration, in which the pedestal is movable relative to the support dome, and a locked configuration, in which the pedestal is not movable relative to the support dome.

8. The drain support of claim 7, wherein the locking element includes a locking nut.

9. A drain support configured for installation on a surface, the drain support comprising:

a base at least partially defining a channel, the channel having an outlet configured to be coupled to a drain pipe for draining fluid away from the surface;

a support including, a base ring couplable to the base, a boss offset vertically from the base ring, and a plurality of ribs extending between the base ring and the boss; and a pedestal movably coupled to the boss.

10. The drain support of claim 9, wherein the support defines one or more apertures therein that are in fluid communication with the channel.

11. The drain support of claim 10, further comprising a mesh layer between the plurality of ribs that is configured to allow fluid to flow therethrough and to inhibit debris from entering the channel through the one or more apertures.

12. The drain support of claim 9, wherein the boss includes a set of internal threads therein, and wherein the pedestal includes a set of external threads configured to threadably engage the internal threads of the boss.

13. The drain support of claim 9, wherein the pedestal includes a support disk on one end thereof, and wherein the support disk defines a support surface.

14. The drain support of claim 13, wherein the support surface includes one or more ribs extending therefrom.

15. A support dome for use with a drain defining a channel and an outlet, the support dome comprising:

a base ring configured to be coupled to the drain proximate an end of the drain that is opposite the outlet that is configured to be coupled to a drain pipe for conveying fluid;

a boss offset vertically from the base ring;

a plurality of ribs extending between the base ring and the boss and configured to convey forces therebetween; and a pedestal movably coupled to the boss.

16. The support dome of claim 15, wherein the base ring defines a base ring axis, and wherein the pedestal is movably coupled to the boss in a direction parallel to the base ring axis.

17. The support dome of claim 15, wherein the boss is concentric with the base ring.

18. The support dome of claim 15, wherein the boss includes a set of internal threads, and wherein the pedestal includes a set of external thread configured to threadably engage the internal threads of the boss.

19. The support dome of claim 15, wherein the pedestal includes a support disk on one end thereof.

20. The support dome of claim 19, wherein the support disk defines a support surface thereon, and wherein the support surface includes at least one rib extending outwardly therefrom.

21. The drain support of claim 1, wherein the base defines a flange extending radially outwardly from the channel to define an outer edge, the outer edge of the channel defining a top plane, wherein a portion of the top plane intersects the at least one aperture of the support dome.

22. The drain support of claim 1, wherein a distance between the support surface and the base is adjustable by movement of the pedestal, the pedestal remaining movably coupled to the support dome.

23. The drain support of claim 9, wherein the base defines a flange extending radially outwardly from the channel, wherein the base ring is sized and shaped to correspond to the flange.

24. The drain support of claim 9, wherein the base defines a flange extending radially outwardly from the channel, wherein the base ring is coupled to the flange.

25. The drain support of claim 9, wherein the channel defines a central axis, wherein the pedestal is movable with respect to the boss in a direction parallel with the central axis.

26. The support dome of claim 15, wherein the base ring is sized and shaped to correspond to a flanged portion of the drain.

* * * * *